US010450161B2

(12) United States Patent
Honda

(10) Patent No.: US 10,450,161 B2
(45) Date of Patent: Oct. 22, 2019

(54) ROLL HOLDER AND PRINTER INCLUDING SAME

(71) Applicant: RICOH COMPANY, LTD., Tokyo (JP)

(72) Inventor: Ryo Honda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 369 days.

(21) Appl. No.: 15/407,446

(22) Filed: Jan. 17, 2017

(65) Prior Publication Data

US 2017/0217719 A1 Aug. 3, 2017

(30) Foreign Application Priority Data

Feb. 1, 2016 (JP) ..... 2016-017458

(51) Int. Cl.
*B65H 75/14* (2006.01)
*B41J 15/04* (2006.01)

(52) U.S. Cl.
CPC ..... *B65H 75/14* (2013.01); *B41J 15/04* (2013.01)

(58) Field of Classification Search
CPC .... B65H 75/14; B65H 75/242; B65H 72/246; B65H 2301/41369; B65H 2301/413523; B41J 15/04
See application file for complete search history.

(56) References Cited

U.S. PATENT DOCUMENTS 4,149,682 A * 4/1979 Gustafson ..... B66C 1/54 242/571.3
5,820,069 A * 10/1998 Segura Salvador .. B23B 31/404 242/571.3
5,904,329 A 5/1999 Kanome et al.
7,128,291 B1 * 10/2006 Schanke ..... B65H 19/305 242/533.7
7,506,834 B2 * 3/2009 Lenkl ..... B65H 16/04 242/573.7

(Continued)

FOREIGN PATENT DOCUMENTS

CN 1132716 A 10/1996
CN 1165744 A 11/1997

(Continued)

OTHER PUBLICATIONS

Aug. 23, 2018 Chinese official action in connection with corresponding Chinese patent application No. 201710048035.6.

*Primary Examiner* — William A. Rivera
(74) *Attorney, Agent, or Firm* — Xsensus LLP

(57) ABSTRACT

A roll holder includes a plurality of holder members to fit in and hold axial ends of any of a first roll with a first inner diameter and a second roll with a second inner diameter greater than the first inner diameter. Each holder member includes a base opposed to an axial end of any of the first roll and the second roll; a plurality of support switches; and a lock. The support switch is movable in an axial direction between a support position to support the second roll with the second inner diameter and a retracted position retracted from the support position to support the first roll with the first inner diameter. The lock locks movement of the plurality of support switches and releases locking of movement of the plurality of support switches when each of the plurality of holder members is fitted in the first roll.

8 Claims, 16 Drawing Sheets

(56) References Cited

U.S. PATENT DOCUMENTS

| | | | | |
|---|---|---|---|---|
| 7,931,229 | B2 * | 4/2011 | Genta | B65H 75/242<br>242/573.9 |
| 9,010,674 | B2 * | 4/2015 | Izumi | B65H 29/008<br>242/571.8 |
| 10,077,166 | B2 * | 9/2018 | Honda | B65H 75/185 |
| 2009/0194631 | A1 * | 8/2009 | Genta | B41J 11/001<br>242/576 |
| 2012/0032021 | A1 * | 2/2012 | Morinaga | B65H 75/08<br>242/577 |
| 2016/0130110 | A1 * | 5/2016 | Honda | B65H 75/185<br>242/574 |

FOREIGN PATENT DOCUMENTS

| | | | |
|---|---|---|---|
| CN | 102259769 | A | 11/2011 |
| CN | 105584864 | A | 5/2016 |
| JP | 2003-276911 | | 10/2003 |
| JP | 2009-173428 | | 8/2009 |
| JP | 2012-066932 | | 4/2012 |
| JP | 2013-100154 | | 5/2013 |
| JP | 2016-102029 | | 6/2016 |

* cited by examiner

ROLL HOLDER AND PRINTER INCLUDING SAME

CROSS-REFERENCE TO RELATED APPLICATION

The present application claims priority pursuant to 35 U.S.C. § 119(a) from Japanese patent application number 2016-017458, filed on Feb. 1, 2016, the entire disclosure of which is incorporated by reference herein.

BACKGROUND

Technical Field

Exemplary embodiments of the present disclosure relate to a roll holder and a printer including the roll holder.

Background Art

There is a printer or an image forming apparatus employing a roll-shaped roll of paper or the like as a printing medium. Such a roll-shaped printing medium employs a roll holder or a roll holding device to handle various paper tubes or hollow shafts with different internal diameters.

SUMMARY

In one embodiment of the disclosure, provided is an optimal roll holder, including a plurality of holder members to fit in and hold axial ends of any of a first roll with a first inner diameter and a second roll with a second inner diameter greater than the first inner diameter. Each of the plurality of holder members includes a base opposed to an axial end of any of the first roll and the second roll; a plurality of support switches movable in an axial direction between a support position in which each of the plurality of holder members is to support the second roll with the second inner diameter and a retracted position retracted from the support position in which each of the plurality of holder members is to support the first roll with the first inner diameter; and a lock to lock movement of the plurality of support switches and release locking of movement of the plurality of support switches when each of the plurality of holder members is fitted in the first roll with the first inner diameter. The lock includes a lock member to lock the plurality of support switches, and is movable between a locked position and a released position while retaining a state in which movement of the plurality of support switches is locked.

In another embodiment of the disclosure, provided is an optimal printer employing the optimal roll holder as featured in the foregoing.

These and other features and advantages of the present disclosure will become apparent upon consideration of the following description of embodiments of the present disclosure when taken in conjunction with the accompanying drawings.

BRIEF DESCRIPTION OF THE DRAWINGS

The aforementioned and other aspects, features, and advantages of the present disclosure would be better understood by reference to the following detailed description when considered in connection with the accompanying drawings, wherein.

DETAILED DESCRIPTION

Hereinafter, embodiments of the present disclosure will be described with reference to accompanying drawings.

First, with reference to FIGS. 1 to 3, an exemplary printer 1000 including a roll holder according to the present disclosure will be described.

Figure 1:
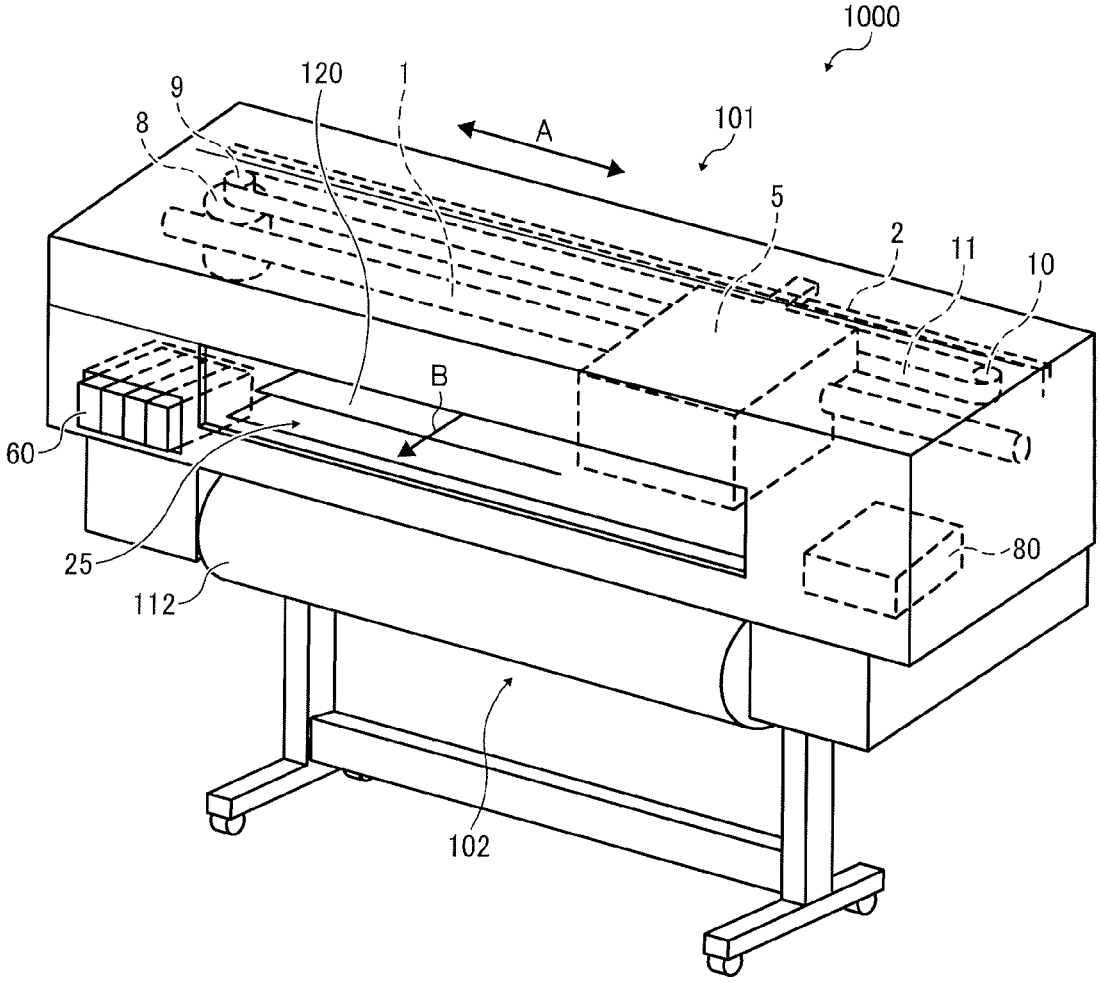
FIG. 1 is an external perspective view of a printer including a roll holder according to an embodiment of the present disclosure.

FIG. 1 schematically illustrates an external perspective view of the printer 1000; FIG. 2 is a side perspective view of the printer 1000; and FIG. 3 is a plan view illustrating a main part of a printing section.

The printer 1000 is a serial-type printer, and includes a printer body 101 and a feeding device 102 disposed below the printer body 101. The feeding device 102 may be a body separate from the printer body 101. Alternatively, it may be a body integrated into the printer body 101 as illustrated in FIG. 2.

There is provided a printing section 103 inside the printer body 101. The printing section 103 forms an image on a rolled paper 120 being a roll-shaped medium fed out from the feeding device 102.

The printing section 103 includes side plates on both sides, a guide rod 1 and a guide stay 2 stretched on the side plates, and a carriage 5 held on the guide rod 1 and the guide stay 2 to be movable along a direction indicated by Arrow A, that is, a main scan direction and carriage moving direction.

A main scan motor 8, a drive source to drive and reciprocally move the carriage 5 is disposed at one end in the main scan direction. A timing belt 11 is stretched around a drive pulley 9 driven to rotate by the main scan motor 8 and a driven pulley 10 disposed at another end opposite the drive pulley 9. The belt holder of the carriage 5 is secured to the timing belt 11, and when the main scan motor 8 is driven, the carriage 5 can be reciprocally moved in the main scan direction.

A plurality of liquid discharge heads 6*a*, 6*b*, 6*c*, and 6*d* (to be denoted as a head 6, if each head is not discriminated) is disposed to the carriage 5. The head 6 is formed as an integrated unit with a head tank to supply a liquid to the head 6.

Herein, the head 6*a* and the heads 6*b*, 6*c*, and 6*d* are shifted by a distance of one nozzle row in a sub-scan direction perpendicular to the main scan direction. In addition, the head 6 includes a nozzle row including a plurality of nozzles disposed in the sub-scan direction perpendicular to the main san direction, with a discharge head directed downward.

In addition, each of the heads 6*a*, 6*b*, 6*c*, and 6*d* includes two nozzle rows. The heads 6*a* and 6*b* discharge a black liquid from each of the two nozzle rows. The head 6*c* includes one nozzle row to discharge a cyan (C) and the other row is not used. The head 6*d* includes one nozzle row to discharge a yellow (Y) liquid and the other nozzle row to discharge a magenta (M) liquid.

With this configuration, a monochrome image is printed with the heads 6*a* and 6*b* with a width of two heads by one scan (in the main scan direction). A color image is printed with, for example, the heads 6*b*, 6*c*, and 6*d*. It is noted that the head configuration is not limited to the above, and all the plurality of heads may be positioned in parallel in the main scan direction.

Each color of liquid is supplied, via a supply tube, from a liquid cartridge 60 as a main tank replaceably mounted to the printer body 101.

In addition, an encoder sheet 40 is disposed along a moving direction of the carriage 5, and an encoder sensor 41 to read the encoder sheet 40 is mounted on the carriage 5. The encoder sheet 40 and the encoder sensor 41 form a linear encoder 42. A position and speed of the carriage 5 is detected from an output of the linear encoder 42.

In a printing area of the main scan area of the carriage 5, the rolled paper 120 is fed from the feeding device 102, and is conveyed intermittently in the sub-scan direction perpendicular to the main scan direction, that is, in a sheet conveyance direction as indicated by Arrow B.

A feeding section 21 includes a feed roller 23 to feed the rolled paper 120 being a roll-shaped medium supplied from the feeding device 102, and a pressure roller 24 disposed opposite the feed roller 23. The feeding section 21 further includes a conveyance guide 25 that includes a plurality of suction holes, and a suction fan 26 to perform suctioning from the suction holes of the conveyance guide 25 that are disposed downstream of the feed roller 23.

Figure 2:
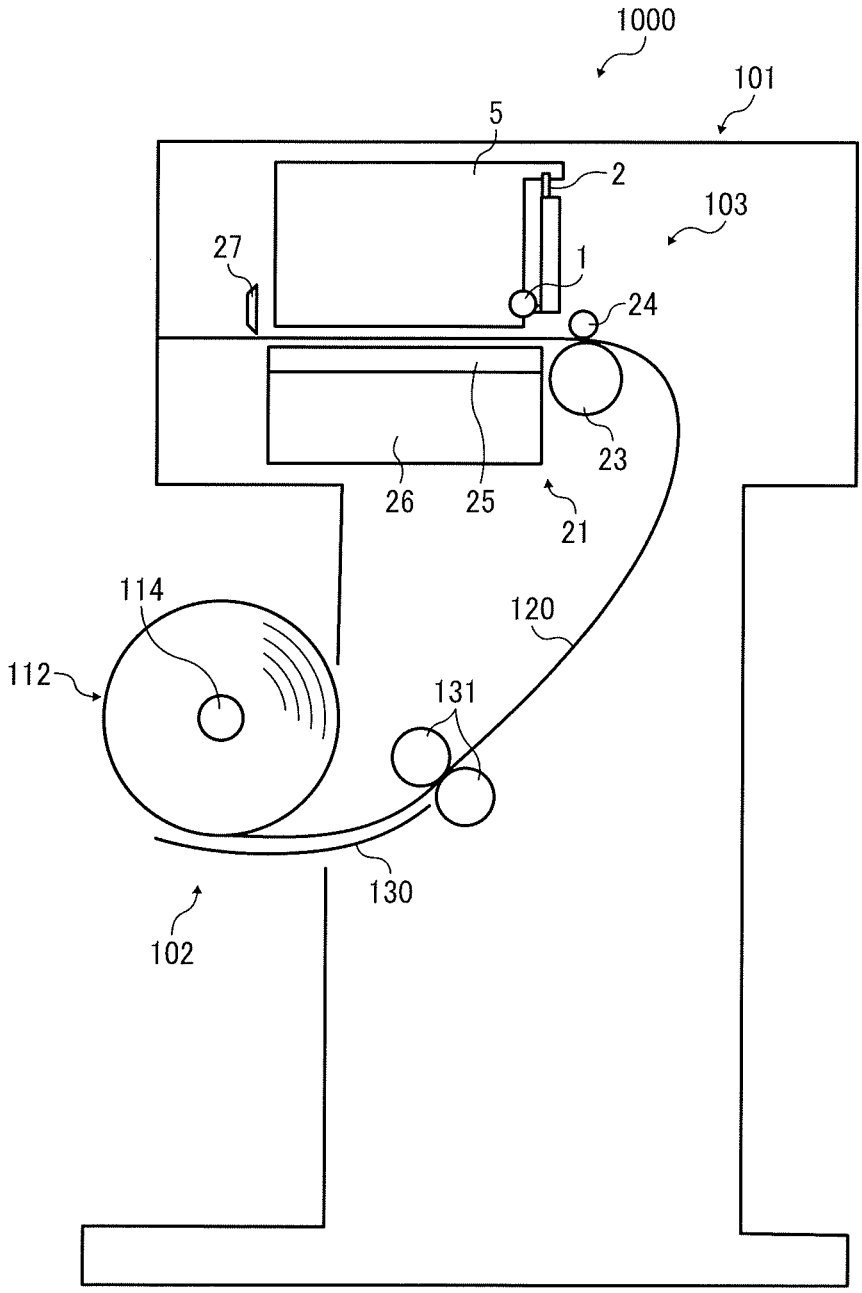
FIG. 2 schematically illustrates a side view of the printer of FIG. 1.
Figure 3:
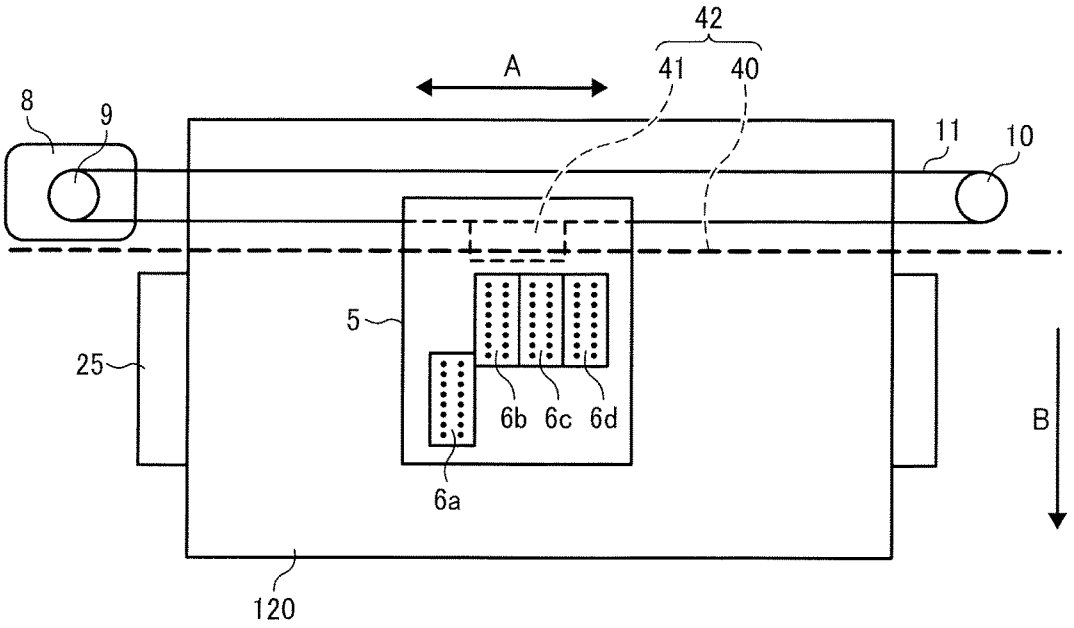
FIG. 3 illustrates a plan view of a main part of an image forming section of the printer.

As illustrated in FIG. 2, a cutter 27 to serve as a cutting device to cut the rolled paper 120, on which the head 6 forms an image, at a predetermined length is disposed downstream of the feeding section 21.

Further, a maintenance device 80 to maintain the head 6 is disposed at a side of the conveyance guide 25 on one side of the carriage 5 in the main scan direction.

The feeding device 102 includes a roll 112. The roll 112 includes a hollow shaft 114 and a sheet 120 (referred to as the rolled paper 120 as described above), a long rolled medium, wound around the hollow shaft 114 serving as a core member such as a paper tube.

In the present embodiment, the roll 112 is configured such that an end of the rolled paper 120 is attached to the hollow shaft 114 with an adhesive. Alternatively, the end of the rolled paper 120 is not attached to the hollow shaft 114 with an adhesive. Both types of rolled paper 120 may be employed.

The end of the roll 112 is held by a roll holder, which will be described later, and supported by a spool 200 (to be described later).

At a side of the printer body 101, a guide 130 to be drawn from the roll 112 of the feeding device 102, and a feed roller pair 131 to bend and feed the rolled paper 120 upward.

When the feed roller pair 131 is driven to rotate, the rolled paper 120 fed from the roll 112 is conveyed while being stretched between the feed roller pair 131 and the roll 112. Then, the rolled paper 120 passes through the feed roller pair 131 and is fed between the feed roller 23 and the pressure roller 24 of the feeding section 21.

Then, the carriage 5 is moved in the main scan direction, and the rolled paper 120 conveyed from the feeding device 102 is intermittently sent by the feeding section 21. The liquid is discharged from the head 6 based on image data or print data, and a predetermined image is printed on the rolled paper 120. The rolled paper 120 after printing is cut by the cutter 27 by a predetermined length, is guided by an ejection sheet guide disposed on a front side of the printer body 101, and is discharged and stored inside a bucket.

Next, one exemplary roll holder will be described with reference to FIGS. 4 to 6.

Figure 4:
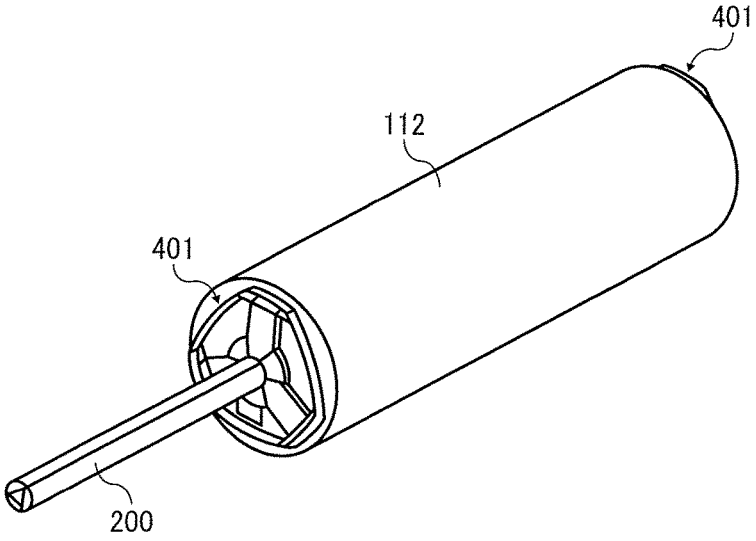
FIG. 4 is a perspective view illustrating a state in which a roll is held by the roll holder.
Figure 5:
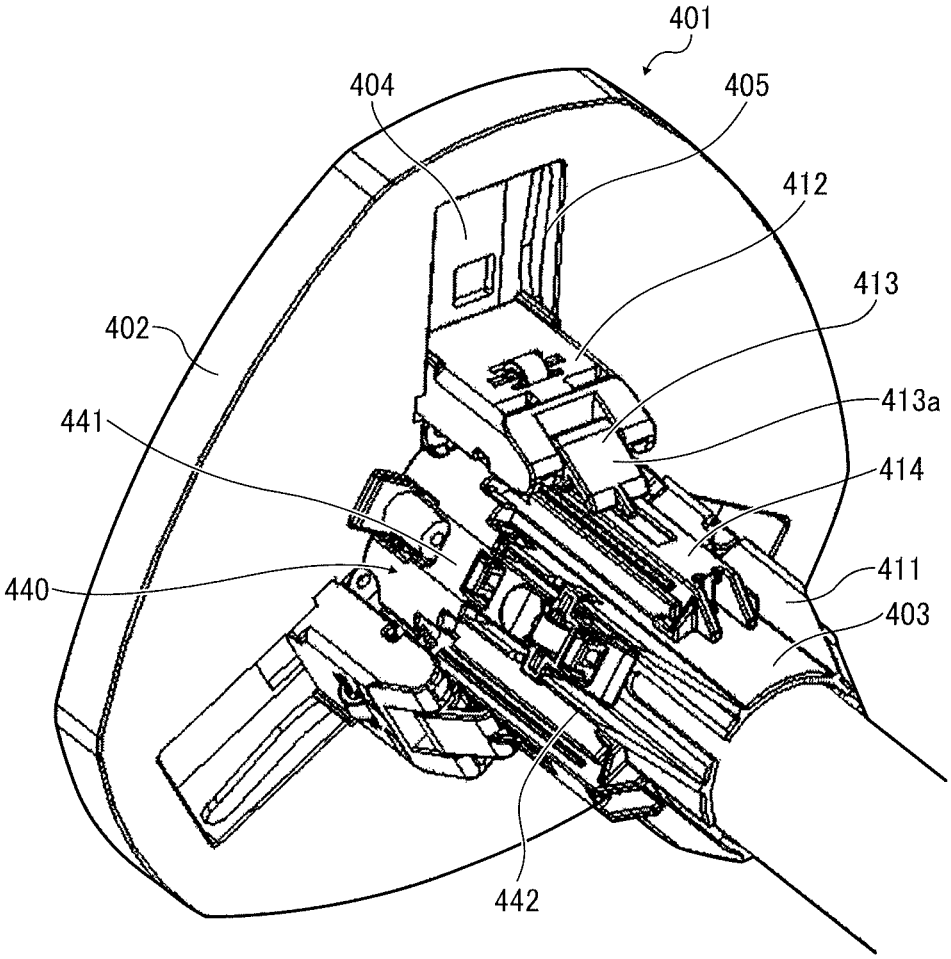
FIG. 5 is a perspective view illustrating a state in which a roll having a second inner diameter is held.
Figure 6:
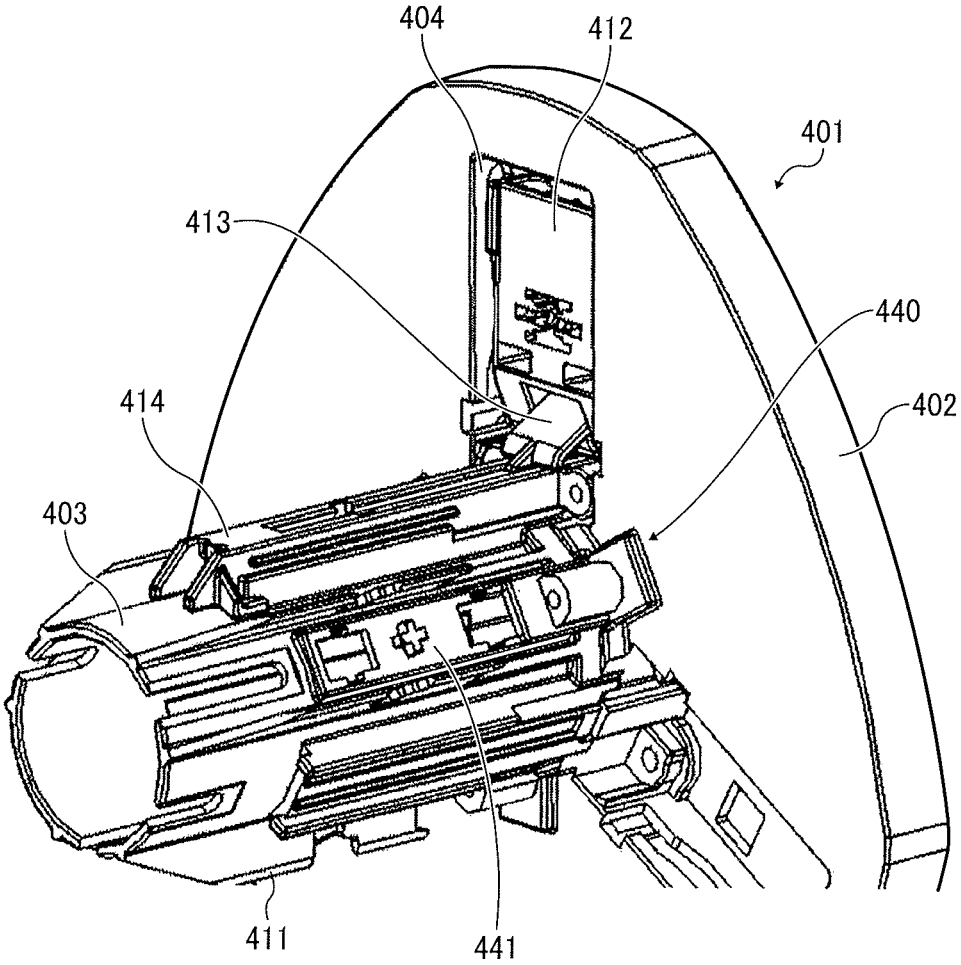
FIG. 6 is a perspective view illustrating a state in which a roll having a first inner diameter is held.

FIG. 4 is a perspective view of a state in which the roll is held by the roll holder, and FIG. 5 is a perspective view of a state in which the roll with a second inner diameter is held by the roll holder, and FIG. 6 is a perspective view of a state in which the roll with a first inner diameter is held by the roll holder.

The roll holder includes holder members 401 fitted in ends of the roll 112.

As illustrated in FIG. 4, the holder members 401 are two types of holder members, that is, a secured-side holder member 401 and a movable side holder member 401. The secured side holder member 401 is secured to the spool 200. The movable side holder member 401 is movable in the axial direction of the spool 200 matched with a size of the roll 112.

As illustrated in FIGS. 5 and 6, the holder member 401 includes a base 402 corresponding to a flange opposed to the end of the roll 112, and an axial tube 403 as a hollow boss to be inserted into the hollow shaft 114 of the roll 112.

The holder member 401 includes three support switches 412 movable in the axial direction.

Each support switch 412 is movable between a support position (as illustrated in FIG. 5), in which the roll 112 with the second inner diameter can be supported, and a retracted position (as illustrated in FIG. 6), in which the roll 112 with the first inner diameter can be supported.

The base 402 of the holder member 401 includes a container 404 to store the support switch 412 at a retracted position. The base 402 includes a guide rail 405 to regulate a rotation angle of the support switch 412.

The support switch 412 rotates about a link 413 and slides in an axial direction, and is thrusted to be shortened and stored in the container 404 of the base 402 of the holder member 401.

The axial tube 403 includes a hollow portion in which the spool 200 is inserted, and a guide rib 411 to contact an inner periphery of the hollow shaft 114 of the roll 112 with the first inner diameter and to guide the hollow shaft 114.

In addition, the axial tube 403 includes a guide rail 414 to regulate a sliding position of the support switch 412 and a guide rail 442 to regulate a moving direction of a lock member 441.

The support switch 412 is attached to the guide rail 405 via the boss, and is attached to the guide rail 414 via the link 413 rotatably supported to the shaft of the support switch 412. The link 413 includes a taper portion 413*a* to disperse a load in the thrust direction when the holder member 401 fits in or enters the roll 112.

As illustrated in FIG. 5, when the support switch 412 is positioned on the axial tube 403 as a support position, the roll of the second inner diameter, (for example, a size of three-inch paper tube) is supported by the support switch 412.

As illustrated in FIG. 6, when the support switch 412 is retracted from the axial tube 403 and is stored in the container 404 as a retracted position, the roll of the first inner diameter, (for example, a size of two-inch paper tube) is supported by the periphery of the axial tube 403.

A lock member 441 constituting a lock 440 moves along a guide rail 442, and stops a movement of the support switch 412 that switches, by latching, a support size from the roll 112 with the second inner diameter to the roll 112 with the first inner diameter.

When the roll holder is fitted in the 2-inch roll 112 having the first inner diameter of 2 inches, an edge face in the axial direction of the hollow shaft 114 of the roll 112 contacts the taper portion 413*a* of the link 413. In this case, the lock member 441 releases the lock of the support switch 412.

With this configuration, the link 413 slides in the axial direction, the support switch 412 while rotating slidably moves along the guide rail 405, and is installed in the container 404 of the base 402. As a result, the roll 112 of the first inner diameter is supported by the guide rib 411 of the axial tube 403.

When the roll holder is fitted in the 3-inch roll 112 of the second inner diameter, the support switch 412 is retained at the support position because the lock member 441 is locking the support switch 412.

With this structure, the support switch 412 enters inside the hollow shaft 114 of the roll 112 with the second inner diameter, so that the roll 112 with the second inner diameter is held by the support switch 412.

The axial tube 403 and the base 402 of the holder member 401 may be integrally foil led or separately formed.

Next, an example of the lock will be described with reference to FIGS. 7 to 14.

Figure 7:
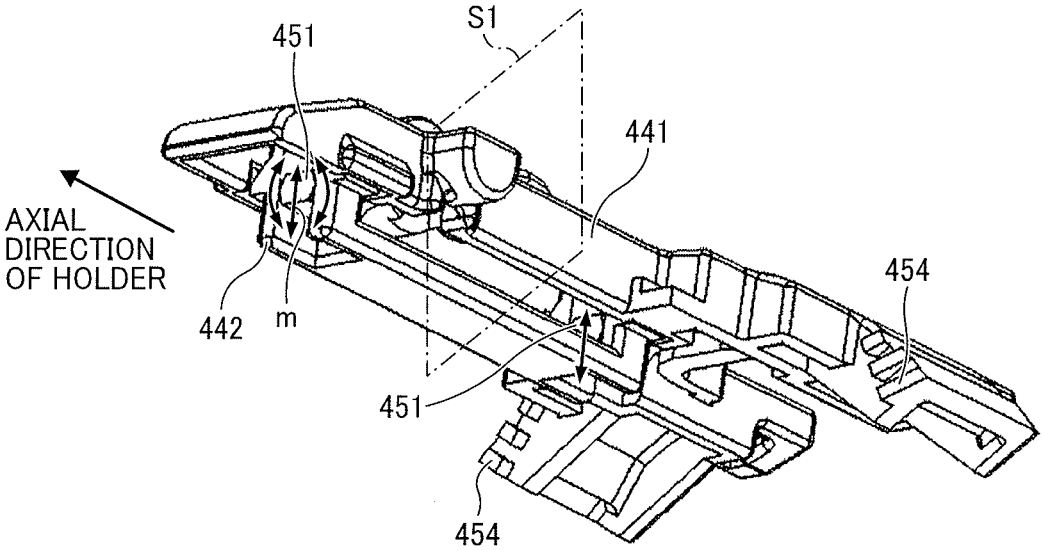
FIG. 7 is a perspective view of a lock member of a lock.
Figure 8:
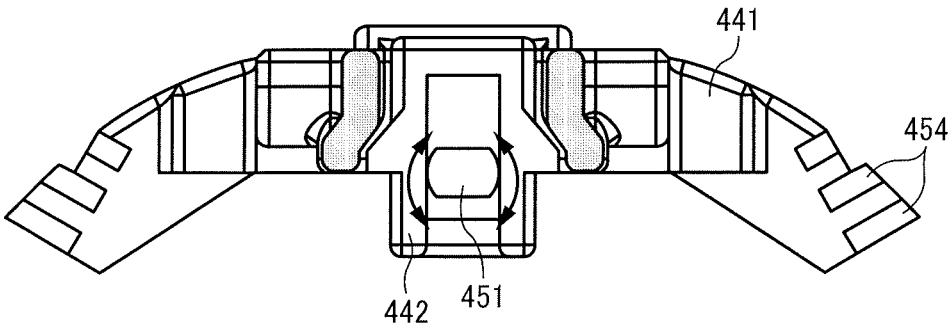
FIG. 8 is a front view of the lock of FIG. 7.
Figure 9:
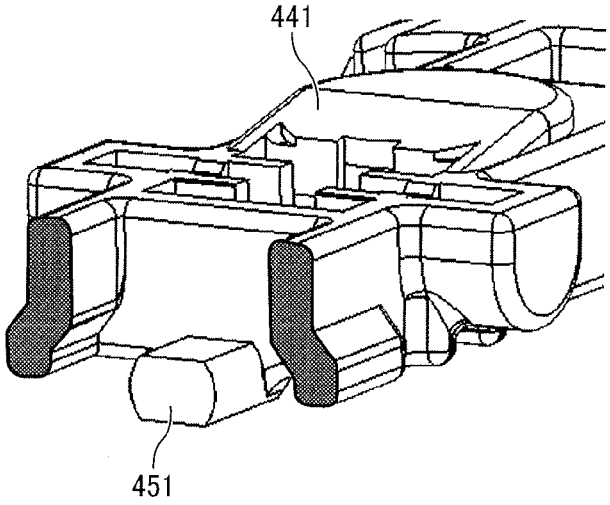
FIG. 9 is a perspective view of a boss portion of the lock.
Figure 10:
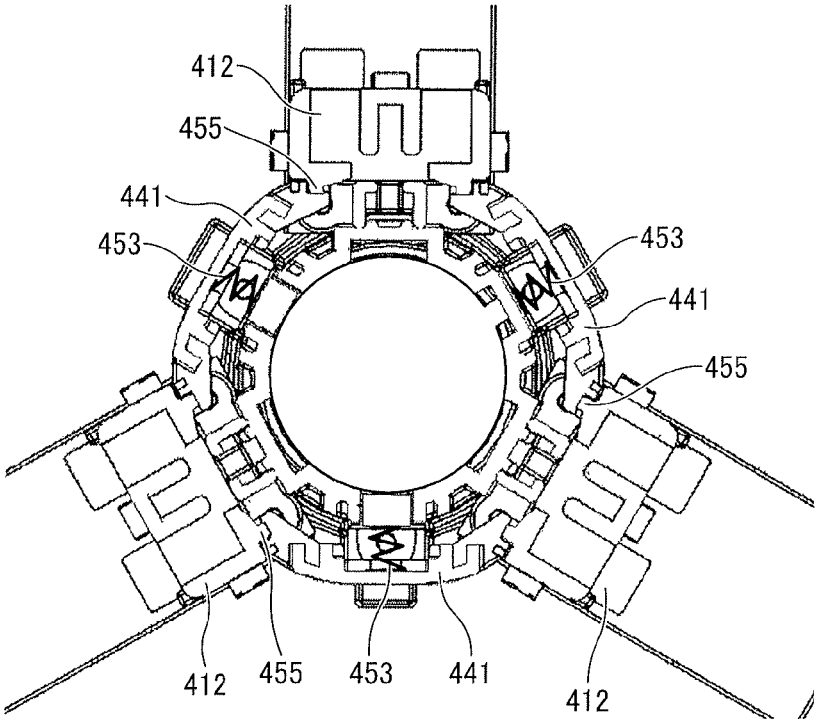
FIG. 10 is a front cross-sectional view illustrating a position of a latch member of the lock.
Figure 11:
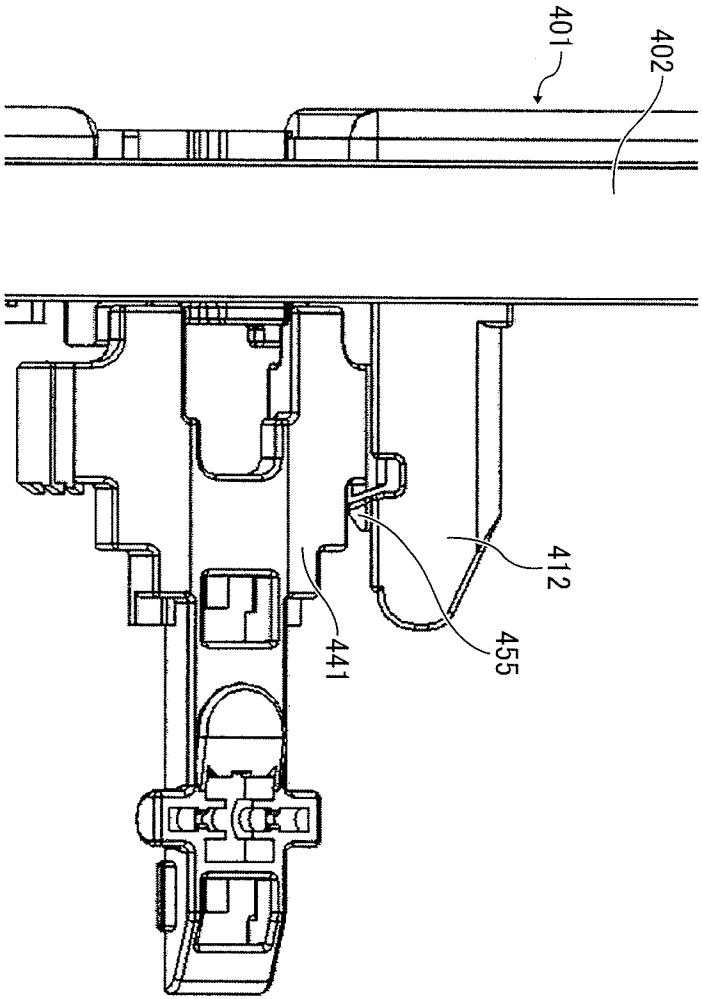
FIG. 11 is a side view of the latch member of the lock.
Figure 12:
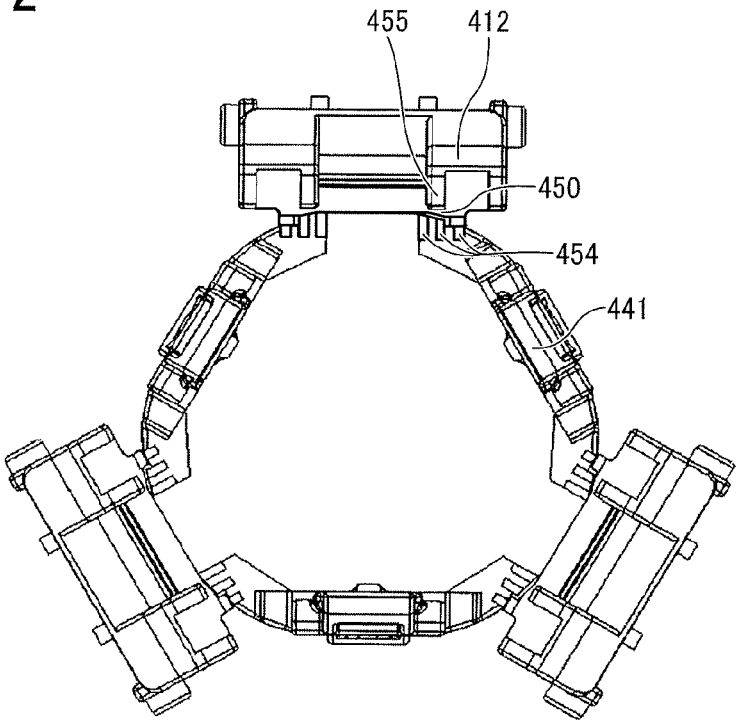
FIG. 12 illustrates a released state observed from an axial direction of the roll.
Figure 13:
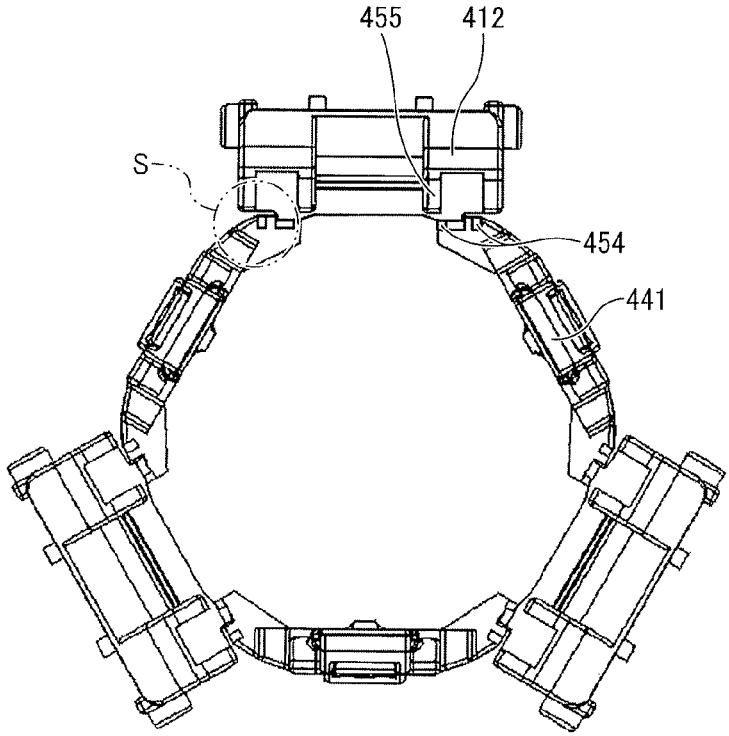
FIG. 13 illustrates a locked state of FIG. 12.
Figure 14:
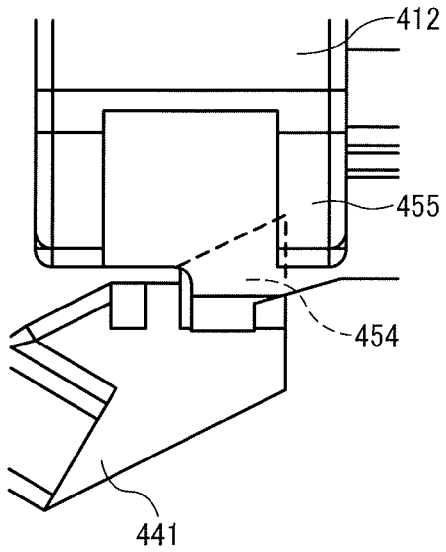
FIG. 14 is an enlarged view of a portion S of FIG. 13.

FIG. 7 is a perspective view of a lock member of a lock; FIG. 8 is a front view of the lock; FIG. 9 is a perspective view of a boss portion of the lock; FIG. 10 is a front cross-sectional view illustrating a position of a latch member of the lock; FIG. 11 is a side view of the latch member of the lock; FIG. 12 illustrates a released state observed from an axial direction of the roll; FIG. 13 illustrates a locked state of FIG. 12; and FIG. 14 is an enlarged view of a portion S of FIG. 13.

The lock 440 includes a lock member 441. A guide rail 442 to regulate the movement of the lock member 441 to a radial direction of the shaft center is disposed on the axial tube 403 of the holder member 401.

The boss 451 of the lock member 441 is movable in a radial direction (that is, Arrow m direction in FIG. 7) along the guide rail 442. Further, the boss 451 has a shape including a circular shape, D-letter shape, or oval shape as illustrated in FIGS. 8 and 9, and is configured such that the lock member 441 is rotatable in the directions indicated by arrows in FIG. 8, that is, pivotally about the shaft center of the holder member 401. In addition, the lock member 441 includes the bosses 451 at two positions to enable a horizontal movement.

With this structure, the lock member 441 is so supported as to be rotatable about the axis or the shaft center direction of the holder member 401.

An elastic member 453 is disposed between the lock member 441 and the axial tube 403 of the holder member 401, and the lock member 441 is biased toward a direction separating from the axis.

The lock member 441 includes a latch member 454 and the support switch 412 includes a latch projection 455 latched by the latch member 454.

When the support switch 412 positions at the support position to support the roll 112 of the second inner diameter, because the lock member 441 positions at the latch position in which the latch member 454 latches the latch projection 455, the movement of the support switch 412 to the axial direction is prevented.

Then, when installed in the roll 112 of the first inner diameter, the lock member 441 is pushed in the direction approaching the shaft center, and the latch member 454 disengages from the latch position in which the latch member 454 latches the latch projection 455, so that the lock of the support switch 412 is released.

Herein, as illustrated in FIG. 10, one support switch 412 includes two or more latch projections 455. One latch member 454 is disposed at the lock member 441 relative to one latch projection 455 of the support switch 412. With this structure, unless two or more locks are released, the support switch 412 does not move.

In addition, as illustrated in FIG. 11, a thrust position of the lock member 441 is defined by the face of the base 402 of the holder member 401.

With this configuration, as illustrated in FIG. 12, when the lock is released, the lock member 441 approaches the shaft center, and a gap 450 is formed between the latch projection 455 of the support switch 412 and the latch member 454 of the lock member 441, so that the support switch 412 can be movable.

On the other hand, as illustrated in FIGS. 13 and 14, when the lock member 441 is separated from the shaft center and the latch projection 455 of the support switch 412 and the latch member 454 of the lock member 441 are overlapped and contacted each other, the movement of the support switch 412 is locked.

Next, referring to FIGS. 15 to 17, the roll holder according to the embodiment of the present disclosure will be described.

Figure 15:
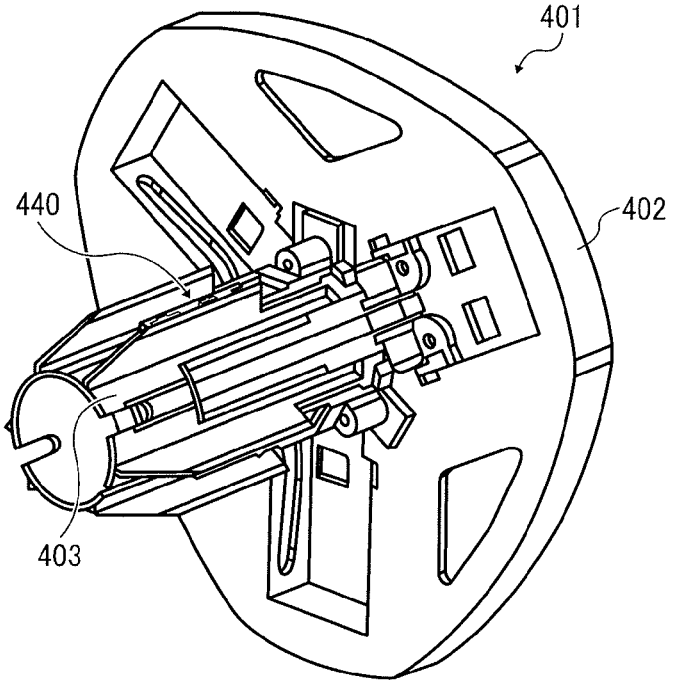
FIG. 15 is a perspective view of a holder member in the roll holder according to the embodiment of the present disclosure.

FIG. 15 is a perspective view of the holder member in the roll holder; FIG. 16 is a cross-sectional view illustrating a state in which a switching member of the roll holder is locked; and FIG. 17 is a perspective view of a guide of the holder member.

The base 402 of the holder member 401 includes a guide portion 501 to guide the lock member 441 in the shaft center direction. The guide member 501 has a slant shape, and the slant shape is slanted to the depth in the axial center as illustrated in FIG. 16, that is, the guide portion 501 is slanted such that the lock member 441 moves in a direction as indicated by Arrow D.

The support switch 412 includes a latch member 504 to contact a lock receiving face 503 as a contact face of the lock member 441 on the way of moving to the retracted position.

The lock receiving face 503 has a tapered shape with a slant such that the latch member 504 of the support switch 412 contacts a hook matched with a rotation locus of the latch member 504 of the support switch 412. With this structure, the lock member 441 receives a load to prevent the lock member 441 from moving to the lock releasing direction.

An elastic member 505 is disposed between the lock member 441 and the holder member 401. A center of the mount position of the elastic member 505 relative to the lock member 441 is shifted from the center of the mount position of the elastic member 505 relative to the holder member 401.

With this structure, the lock member 441 is biased to a direction approaching the guide portion 501 along the axial direction (that is, Arrow D direction), and is biased to a direction perpendicular to the axial direction and opposite the axial direction (that is, Arrow C direction).

Due to the biasing force of the elastic member 505, the lock member 441 contacts the guide portion 501 of the holder member 401, and moves along the slant shape of the guide portion 501.

The lock receiving face 503 has a slanted face as a hook so that the support switch 412 is latched, thereby increasing the locking force.

In addition, a shift amount of the lock member 441 moving in the axial direction while contacting the guide portion 501 of the holder member 401 is made greater than an axial component of a hook amount of the latch member 504 of the support switch 412 and the lock receiving (contacting) face 503 of the lock member 441, in other words, a length of an area in the axial direction in which the latch member 504 of the support switch 412 contacts the lock receiving (contacting) face 503 of the lock member 441.

Further, the slant angle of the lock receiving face 503 of the support switch 412 during shifting is less than the slant angle of the guide portion 501 of the holder member 401.

With this structure, while retaining the lock state, when the lock member 441 moves in the axial direction, the lock is released, and the state moves from the released state to the locked state.

Specifically, as illustrated in FIG. 14, because the support switch 412 is locked by the plurality of lock members 441, the state in which the movement of the support switch 412 is locked is being retained by one lock member 441, the other lock members 441 are movable between the lock position and the released position, due to the relation of the slant angle between the slant angle of the lock receiving face 503 of the lock member 441 and the slant angel of the guide portion 501 of the holder member 401.

Figure 16:
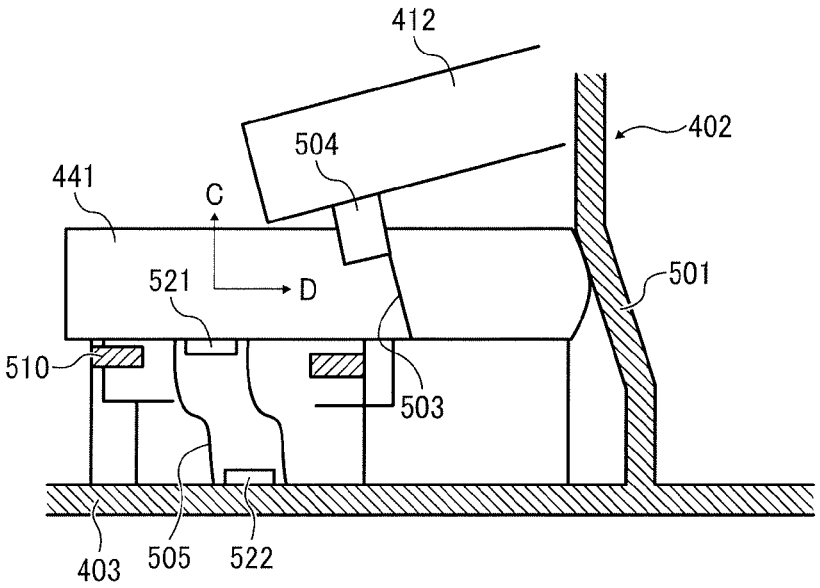
FIG. 16 is a cross-sectional view illustrating a state in which a support switch is locked.
Figure 17:
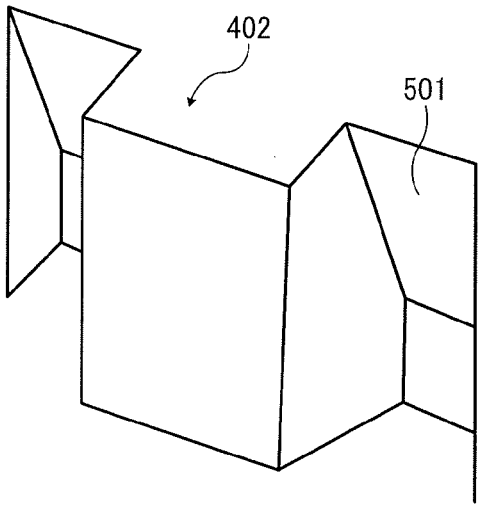
FIG. 17 is a perspective view of a guide member of the holder member.

With this structure, as illustrated in FIG. 16, in a state in which the latch member 504 of the support switch 412 contacts the lock receiving face 503 of the lock member 441, one lock member 441 is moved to the lock release position or in the direction opposite the Arrow C direction in FIG. 16. Even though the lock member 441 is moved reciprocally from the released position to the locked position, because the elastic member 505 biases the lock member 441 to the Arrow D direction, the lock member 441 moves along the slant surface while contacting the slant surface of the guide portion 501 of the holder member 401. As a result, the lock member 441 moves along the tapered shape relative to the latch member 504 of the support switch 412.

In other words, in a state in which the support switch 412 is locked, even though the lock member 441 is moved from the locked position to the released position, and moved from the released position to the locked position, because the lock member 441 moves along the slant shape of the guide portion 501 with a greater slant angle, a gap of the slant shape of the guide portion 501 of the holder member 401 and a latch claw of the support switch 412 can be widened, to thereby move to the lock position.

Next, referring to FIGS. 18 to 21, a structure related to the movement of the lock member is described.

Figure 18:
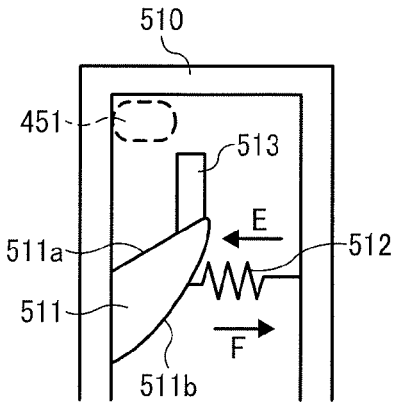
FIG. 18 illustrates a structure of a lock guide of the holder member.
Figure 19:
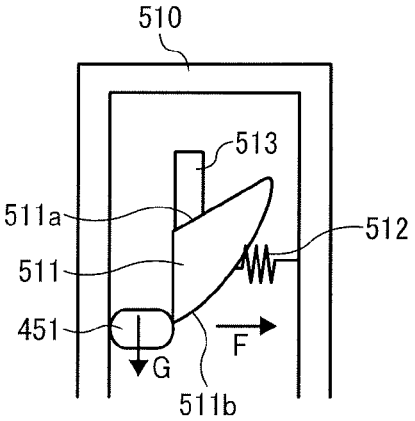
FIG. 19 illustrates a path in which the lock member moves from the locked state to the released state.
Figure 20:
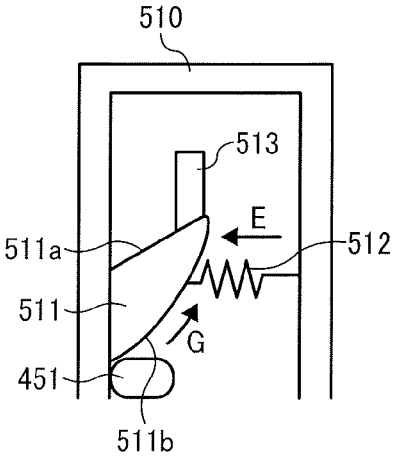
FIG. 20 illustrates a path in which the lock member moves from the released state to the locked state.
Figure 21:
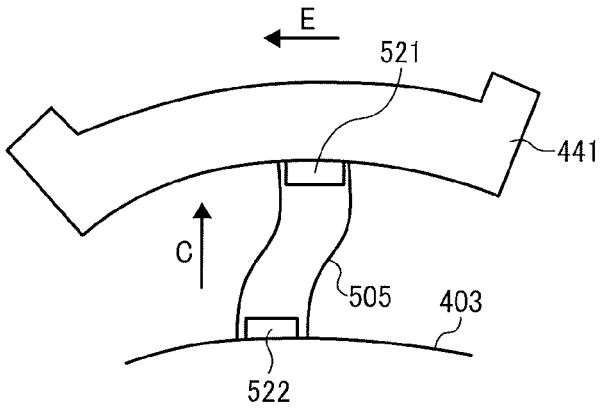
FIG. 21 illustrates positions of the lock member and an elastic member.

FIG. 18 illustrates a structure of a lock guide of the holder member; FIG. 19 illustrates a path in which the lock member moves from the locked state to the released state; FIG. 20 illustrates a path in which the lock member moves from the released state to the locked state; and FIG. 21 illustrates positions of the lock member and an elastic member.

The lock member 441 moves reciprocally between the lock position in which the boss 451 positions as illustrated in FIG. 18 and the released position in which the boss 451 positions as illustrated in FIG. 20.

The lock member 441 includes a lock guide 510 to guide the lock member 441 from the locked position to the released position (that is, an outward movement) and from the released position to the locked position, that is, a homeward movement).

The lock guide 510 includes a path switch member 511 to switch a moving path of the outward movement and the homeward movement of the lock member 441.

The path switch member 511 is held movably to Arrow E direction and Arrow F direction relative to the lock guide 510, and is biased toward Arrow E direction by an elastic member 512. The path switch member 511 further includes a switch member guide 513 to guide the movement of the path switch member 511.

In the switch member guide 513, when the lock member 441 moves in Arrow G direction in FIG. 19 from the locked position in FIG. 18 to the released position in FIG. 20, the boss 451 of the lock member 441 contacts a taper portion 511*a* of the path switch member 511. Then, the path switch member 511 moves in Arrow F direction guided by the switch member guide 513 following the movement of the boss 451 in Arrow G direction.

With this structure, as illustrated in FIG. 20, the lock member 441 moves from the locked position in which the boss 451 positions at a position illustrated by a broken line, to the released position in which the boss 451 positions at a position illustrated by a solid line. When the boss 451 moves up to the released position, the elastic member 512 moves the path switch member 511 in Arrow E direction to the original position.

The boss 451 of the lock member 441 moves along an arc surface 511*b* of the path switch member 511 in Arrow G direction due to a biasing force of the elastic member 505 toward Arrow C direction. When the boss 451 moves up to an upper surface of the lock guide 510, the elastic member 505 attached to the lock member 441 moves the boss 451 in Arrow E direction and to the locked position.

As described above, the outward path in which the lock member 441 moves from the locked position to the lock-release position and the homeward path in which the lock member 441 moves from the released position to the locked position are different.

Herein, as illustrated in FIG. 21, one end of the elastic member 505 is mounted to a mount boss 521 of the side of the lock member 441 and the other end of the elastic member 505 is mounted to a mount boss 522 of the side of the axial tube 403, respectively. The mount boss 521 of the lock member 441 and the mount boss 522 of the axial tube 403 are disposed each at a shifted position in the peripheral direction, so that the lock member 441 is biased by the elastic member 505 in Arrow C direction and is biased in Arrow E direction in the peripheral direction.

Figure 22:
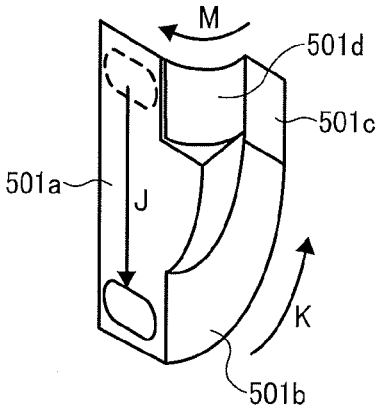
FIG. 22 is a perspective view of an exemplary shape of the guide member included in the holder member.

Next, one exemplary shape of the guide included in the holder member will be described with reference to FIG. 22, a perspective view illustrating the shape of the guide.

The guide portion 501 of the holder member 401 guides to move the lock member 441 to the axial direction.

When the lock member 441 moves from the locked position illustrated by a broken line to the released position illustrated by a solid line, the lock member 441 moves through a planar portion 501*a* as indicated by Arrow J. When the lock member 441 moves from the released position to the locked position, the lock member 441 moves along a slant surface 501*b* as indicated by Arrow K to a planar portion 501*c*, further moves along a slant surface 501*d* as indicated by Arrow M, and returns to the locked position.

Movement of the lock member 441 to a concave portion of the planar portion 501*c*, results in widening a distance between the support switch 412 and the holder member 401, so that the lock member 441 can be returned to the locked position.

Next, embodiments of the roll holder according to the present disclosure will be described with reference to FIGS. 23 to 27.

Figure 23:
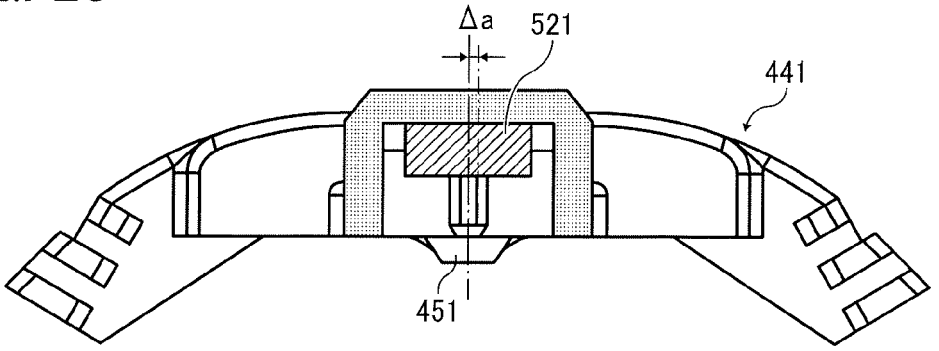
FIG. 23 is a cross-sectional view of the roll holder corresponding to a face S1 of FIG. 7 according to an embodiment of the present disclosure.
Figure 24:
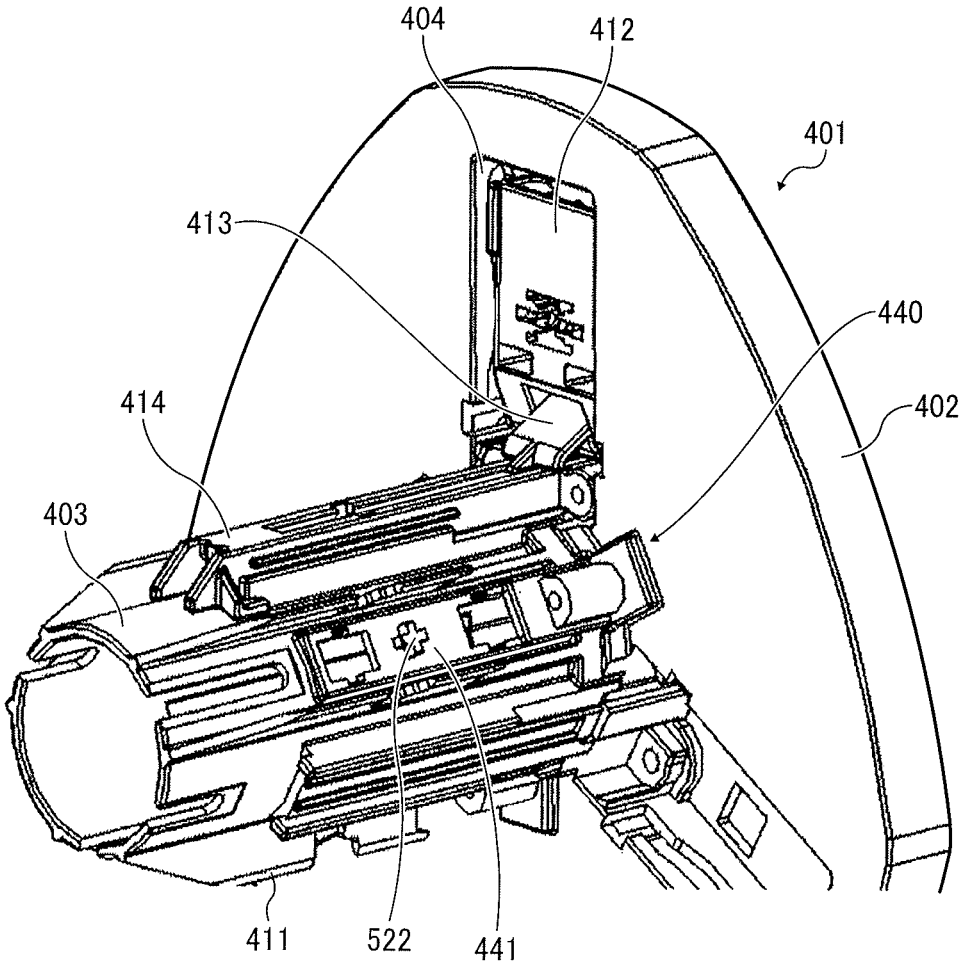
FIG. 24 is a perspective view of a state in which the roll having a first inner diameter is held.
Figure 25:
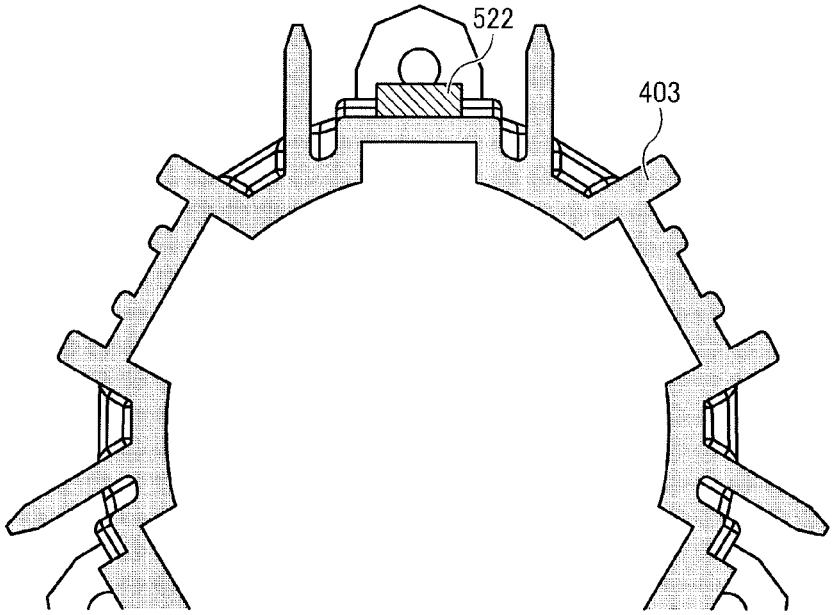
FIG. 25 is a cross-sectional view of an axial tube of the holder member.
Figure 26:
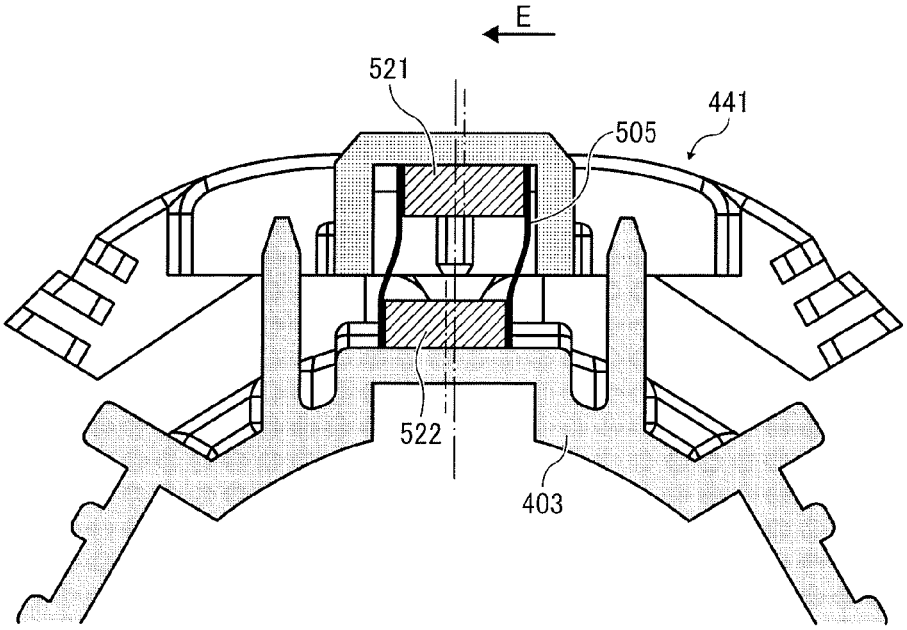
FIG. 26 is a cross-sectional view of the holder member including a cylindrical axial portion in a state in which the lock member is positioned at a locked position.

FIG. 23 is a cross-sectional view of the roll holder corresponding to a face S1 of FIG. 7; FIG. 24 is a perspective view of a state in which the roll having a first inner diameter is held; FIG. 25 is a cross-sectional view of an axial tube of the holder member; FIG. 26 is a cross-sectional view of the holder member including a cylindrical axial portion in a state in which the lock member is positioned at a locked position; and FIG. 27 is a cross-sectional view of the holder member along the axial direction.

Herein, the lock member 441 includes the plurality of mount bosses 521 to retain the elastic member 505 in the peripheral direction, and the axial tube 403 includes the plurality of mount bosses 522 in the peripheral direction.

As illustrated in FIG. 23, the mount boss 521 and the mount boss 522 are shifted amount Δa in the peripheral direction. In addition, as illustrated in FIG. 27, the mount boss 521 and the mount boss 522 are offset or shifted by an amount Δb in the peripheral direction.

Figure 27:
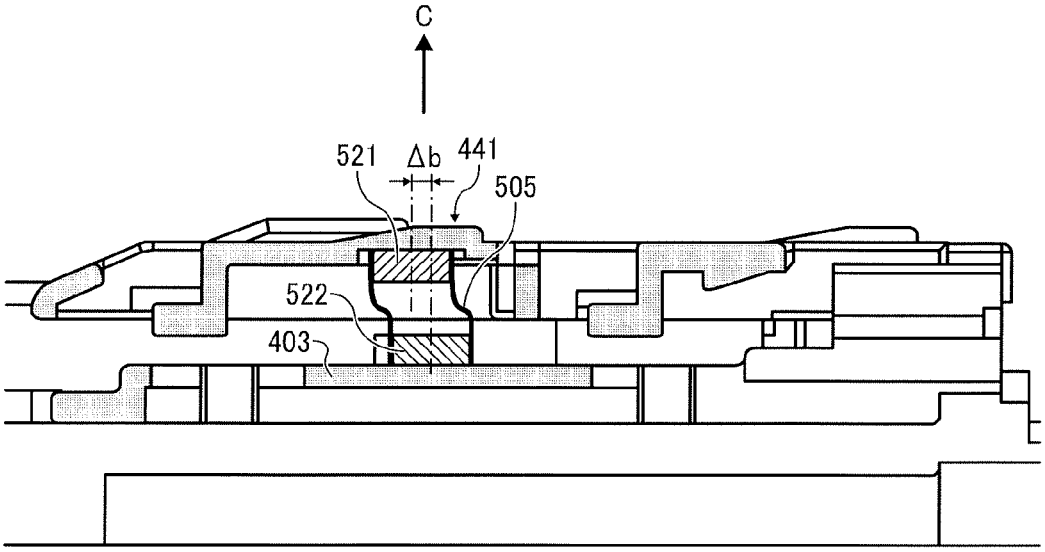
FIG. 27 is a cross-sectional view of the holder member along the axial direction.

Accordingly, when the lock member 441 is mounted to the axial tube 403, the lock member 441 is biased to Arrow C direction by the elastic member 505 as illustrated in FIG. 27, and is biased to Arrow E direction by the elastic member 505 in the peripheral direction.

In the above embodiments, an example in which the printer includes the liquid discharge head has been described; however, the embodiments of the present disclosure are not limited to the above, but may be applied to a roll holder of the printer employing the electrophotographic method.

Additional modifications and variations of the present disclosure are possible in light of the above teachings. It is therefore to be understood that, within the scope of the appended claims, the disclosure may be practiced other than as specifically described herein.

What is claimed is:

1. A roll holder, comprising:

a plurality of holder members to fit in and hold axial ends of any of a first roll with a first inner diameter and a second roll with a second inner diameter greater than the first inner diameter, each of the plurality of holder members including:

a base opposed to an axial end of any of the first roll and the second roll;

an axial tube;

a plurality of support switches movable in an axial direction relative to the axial tube between a support position in which each of the plurality of holder members is to support the second roll with the second inner diameter and a retracted position retracted from the support position in which each of the plurality of holder members is to support the first roll with the first inner diameter; and a lock to lock movement of the plurality of support switches and release locking of movement of the plurality of support switches when each of the plurality of holder members is fitted in the first roll with the first inner diameter, the lock including a lock member to lock the plurality of support switches, the lock member being movable between a locked position and a released position while retaining a state in which movement of the plurality of support switches is locked, wherein the support switches in the support position contact the second inner diameter of the second roll.

2. The roll holder according to claim 1, further comprising:

an elastic member to bias the lock member in the axial direction and a direction perpendicular to the axial direction, wherein each of the plurality of holder members includes a guide portion to guide the lock member, and wherein the lock member slidably moves while contacting the guide portion.

3. The roll holder according to claim 1, wherein the lock member includes a slanted contact surface, and wherein the plurality of support switches includes a latch member to contact and hook on the slanted contact surface of the lock member.

4. The roll holder according to claim 3, wherein each of the plurality of holder members includes a guide portion to guide the lock member, and wherein the lock member is configured to shift more in the axial direction while contacting the guide portion than a length of an area in the axial direction in which each of the plurality of support switches contacts the slanted contact surface of the lock member.

5. The roll holder according to claim 1, wherein the lock member moves from the locked position to the released position along a path that is different from a path in which the lock member moves from the released position to the locked position.

6. A printer comprising the roll holder according to claim 1.

7. The roll holder according to claim 1, wherein the axial tube contacts the first inner diameter of the first roll when the switches are in the retracted position.

8. A roll holder, comprising:

a plurality of holder members to fit in and hold axial ends of any of a first roll with a first inner diameter and a second roll with a second inner diameter greater than the first inner diameter, each of the plurality of holder members including:

a base opposed to an axial end of any of the first roll and the second roll;

an axial tube;

a plurality of support switches movable in an axial direction relative to the axial tube between a support position in which each of the plurality of holder members is to support the second roll with the second inner diameter and a retracted position retracted from the support position in which each of the plurality of holder members is to support the first roll with the first inner diameter; and a lock to lock movement of the plurality of support switches and release locking of movement of the plurality of support switches when each of the plurality of holder members is fitted in the first roll with the first inner diameter, the lock including a lock member to lock the plurality of support switches, the lock member being movable between a locked position and a released position while retaining a state in which movement of the plurality of support switches is locked, wherein the axial tube contacts the first inner diameter of the first roll when the switches are in the retracted position.

* * * * *